United States Patent [19]

Craig

[11] 3,937,380

[45] Feb. 10, 1976

[54] APPARATUS FOR ATTACHING INSULATING MATERIAL TO SHEET METAL

[75] Inventor: J. Andrew Craig, East Greenwich, R.I.

[73] Assignee: Gripnail Corporation, East Providence, R.I.

[22] Filed: Jan. 15, 1975

[21] Appl. No.: 541,361

[52] U.S. Cl. ..... 227/100

[51] Int. Cl.[2] ..... B27F 7/02

[58] Field of Search ..... 227/2, 3, 39, 40, 41, 42, 227/43, 44, 81, 99, 100, 101, 103, 153, 154

[56] References Cited

UNITED STATES PATENTS

| | | | |
|---|---|---|---|
| 1,019,118 | 3/1912 | Ashton | 227/154 X |
| 1,886,971 | 11/1932 | Newhouse | 227/81 |
| 1,999,821 | 4/1935 | Newhouse | 227/24 |
| 2,733,439 | 2/1956 | Pikal | 227/2 |
| 3,666,155 | 5/1972 | Saluzzi | 227/116 X |

*Primary Examiner*—Granville Y. Custer, Jr.
*Attorney, Agent, or Firm*—A. Yates Dowell, Jr.

[57] ABSTRACT

Apparatus mounted on a fixed structure and including a plurality of selectively operable fastener applying guns for securing insulating material to sheet metal without the fastener passing through the sheet metal and while the insulating material and the sheet metal are moving continuously. The apparatus includes a plurality of guns mounted on swinging members and located above a rotating anvil and adjacent to a hold-down roller so that the guns can swing while the fasteners are penetrating the work and move with the work during the time the fasteners are being driven.

7 Claims, 4 Drawing Figures

Fig. 2
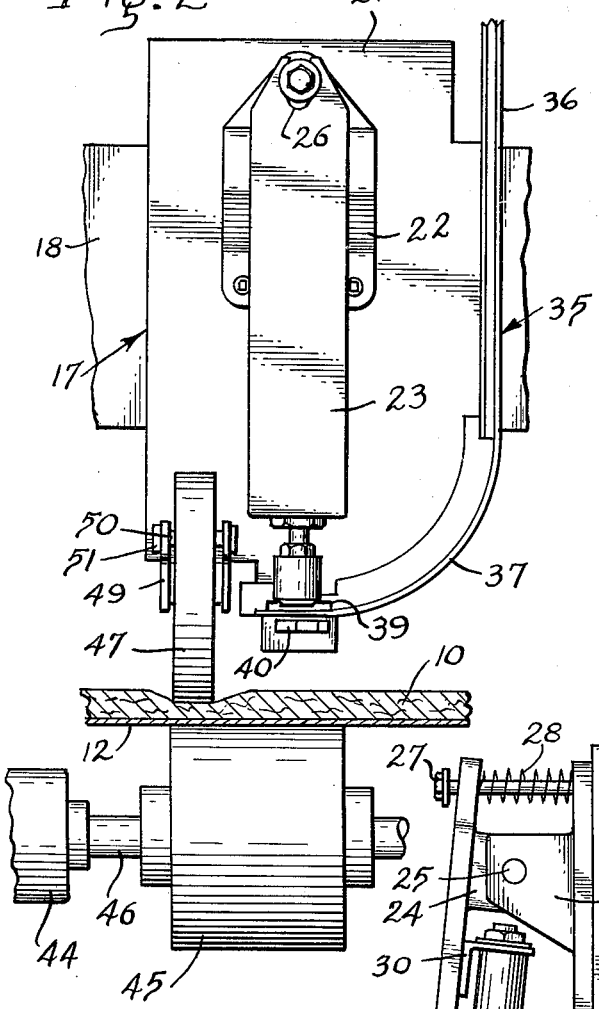
Fig. 3
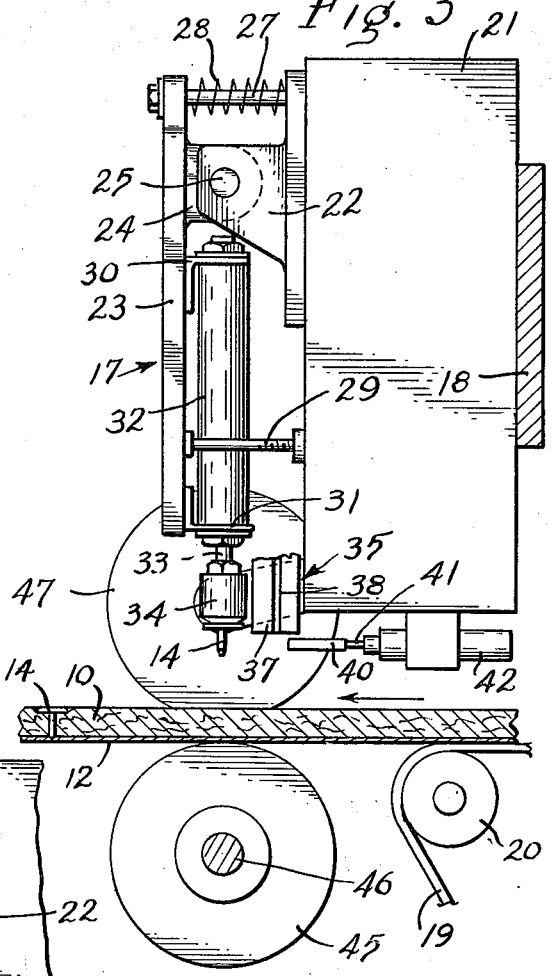
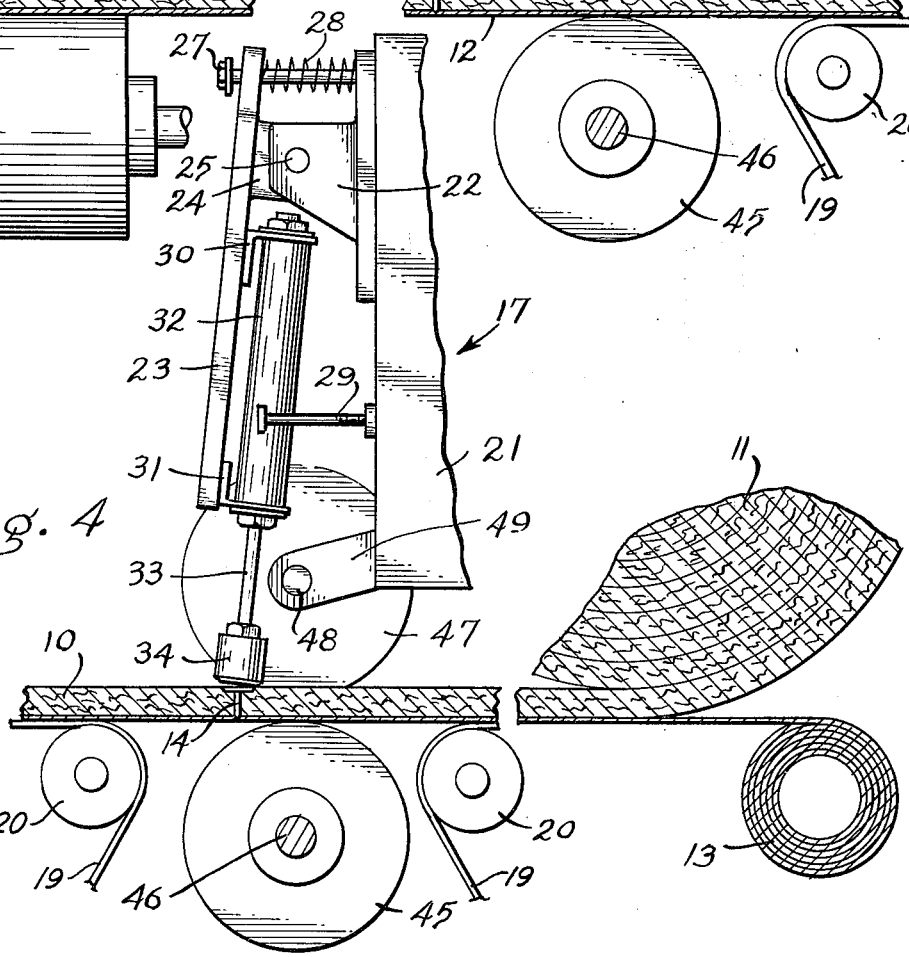
Fig. 4

APPARATUS FOR ATTACHING INSULATING MATERIAL TO SHEET METAL

BACKGROUND OF THE INVENTION

1. Field of the Invention.

This invention relates generally to fasteners of various kinds and relates particularly to fastener applying machines which are swingably mounted on a fixed structure and drive fasteners into a continuously moving workpiece.

2. Description of the Prior Art.

Heretofore many fastener applying machines have been provided for automatically driving a fastener into a workpiece; however, most of these prior art devices were either portable so that the tool was moved to a desired location on the workpiece and then activated, or the work was brought to the tool and the tool was activated while the workpiece was located in fixed position.

Some efforts have been made to provide fastener applying machines capable of driving a fastener into a workpiece while one of the elements was moving relative to the other. Some examples of the prior art are U.S. Pat. Nos. 1,999,821 to Newhouse; 3,576,286 to Bunch; 3,666,155 to Saluzzi; and 3,774,833 to Deshich.

SUMMARY OF THE INVENTION

The present invention is a fastener applying machine having a plurality of guns which are swingably mounted on a fixed frame and each of such guns is associated with a rotary anvil and a hold-down roller. Such fastener applying machine is capable of driving one or more fasteners through a layer of insulating material and into sheet metal while the insulating material and the sheet metal are continuously moving and without causing the fastener to penetrate entirely through the sheet metal.

BRIEF DESCRIPTION OF THE DRAWINGS

FIG. 2 is a front elevation of one of the nailing guns.

FIG. 3 is a side elevation thereof.

FIG. 4 is a side elevation illustrating the relationship of the parts while the fastener is being driven.

DESCRIPTION OF THE PREFERRED EMBODIMENT

Figure 1:
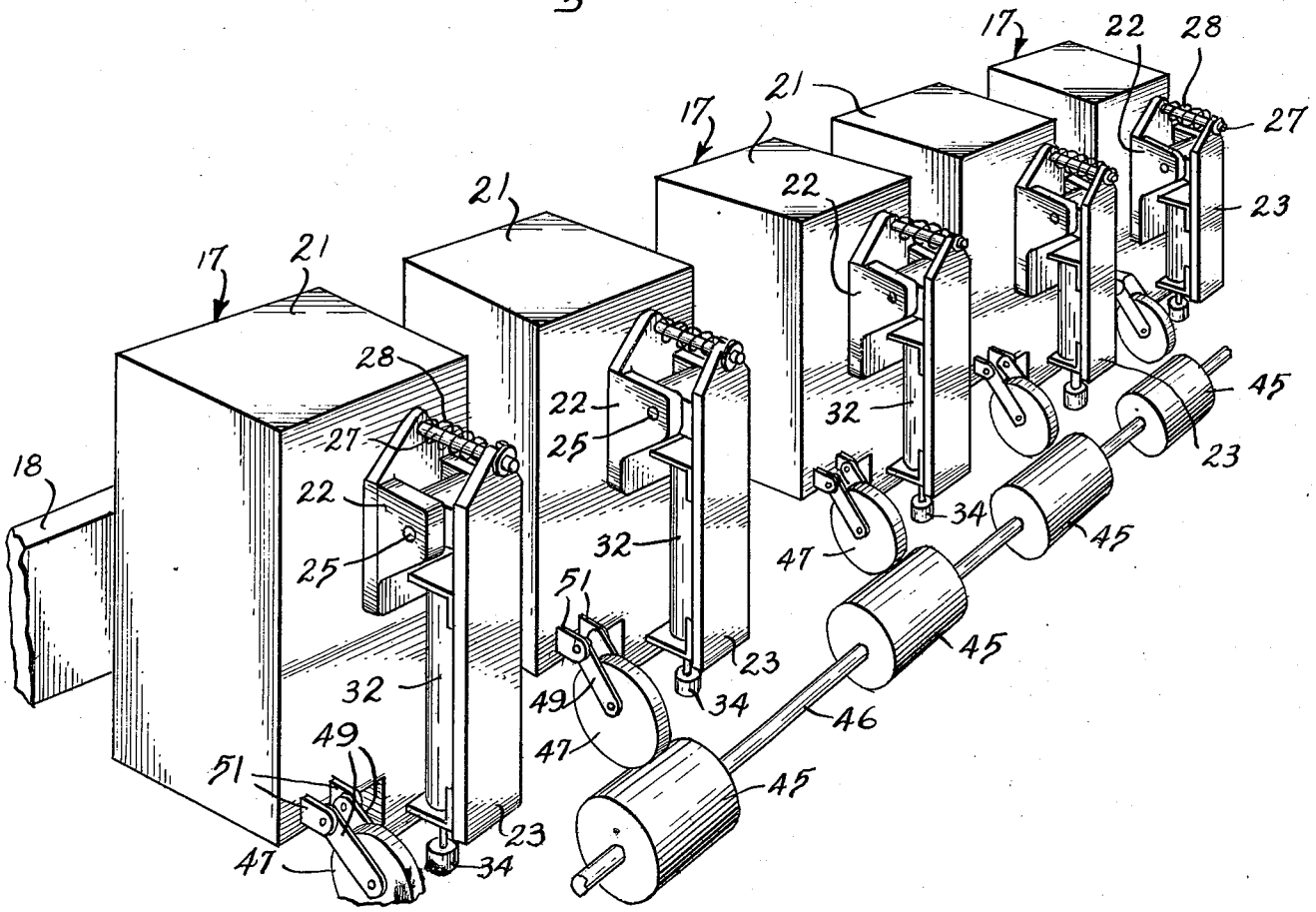
FIG. 1 is a perspective illustrating one application of the fastener applying machine of the present invention.

With continued reference to the drawings, a layer of insulating material 10 which is usually stored in a coil 11 of indefinite length is to be secured to a strip of sheet metal 12 which normally is wound into a coil 13. In order to mount the insulating material 10 on the sheet metal 12 without penetrating entirely through the sheet metal, a fastener 14, such as shown in U.S. Pat. No. 3,095,777 to Hallock, is driven through the insulating material and into the sheet metal in such a manner that the penetrating end of the fastener does not pass entirely through the sheet metal but instead is deformed slightly to clinch a globule of metal and prevent easy withdrawal of the fastener.

In order to drive one or more fasteners 14, a plurality of fastener applying guns or machines 17 are mounted on the upper support 18 of a frame and such frame includes a conventional bed such as a belt type conveyor 19 carried by rollers 20 which supports the strip of sheet metal 12 and the insulating material 10. Each of the fastener applying machines 17 includes a housing 21 having a yoke 22 fixed to the side opposite the upper support 18. A support member 23 is provided with a lug 24 intermediate the ends thereof and such lug is swingably connected by a pivot pin 25 to the yoke 22. Normally the member 23 is located in a generally vertical position and the upper end of such member has a slot 26 through which a stud 27 carried by the housing 21 extends. A compression spring 28 is located about the stud 27 and urges the upper end of the support member 23 outwardly. An adjustable stop 29 is mounted on the housing 21 and extends outwardly to a position to engage and stop the lower end of the member 23 so that the spring 28 normally urges the lower end of the support member 23 against the stop 29.

A pair of upper and lower brackets 30 and 31 are mounted on the member 23 and such upper and lower brackets support a generally vertically disposed fluid cylinder 32. The cylinder 32 has a piston rod 33 extending downwardly therefrom and the lower end of such piston rod is connected to a magnetic driving head 34.

In order to supply fasteners 14 to the driving head 34, a chute 35 is connected to the housing 21 and such chute includes a generally vertical upper portion 36 and an arcuate lower portion 37. The upper portion 36 preferably is connected to a supply of fasteners (not shown) which feeds fasteners continuously into the chute 35 in such a manner that the heads of the fasteners are retained in the chute while the shanks extend outwardly through a slot 38. The arcuate lower portion 37 of the chute terminates adjacent to the driving head 34 and such lower portion is provided with an opening 39 substantially in alignment with the lower end of the magnetic head. A transfer block 40 having a V-shaped notch in its outer end is mounted on the piston rod 41 of a fluid cylinder 42 which is mounted on the bottom of the housing 21. When the fluid cylinder is operated in one direction, the piston rod 41 is extended to cause the transfer block 40 to engage the lowermost fastener in the chute 35 and move such fastener out of the chute through the opening 39 to a position immediately below the driving head 34. In this position the magnetic driving head attracts the fastener 14 and holds such fastener in position on the bottom of the driving head after which the transfer block 40 is retracted.

A rotatable anvil 45 is mounted on a shaft 46 with a portion of the anvil being located directly below the driving head 34 and such shaft is driven in any desired manner by a power plant 44. The anvil 45 directly supports the strip of sheet metal 12 and the insulating material 10 and in order for the anvil to provide the driving force for moving the sheet metal and the insulating material through the machine, a hold-down roller 47 is located above a portion of the anvil and is rotatably mounted by a pivot 48 to an arm 49. The opposite end of such arm is swingably mounted by a pivot 50 to lugs 51 carried by the housing 21. The hold-down roller may be relatively heavy so that it holds the insulating material 10 against the sheet metal 12 by gravity, or if desired a spring (not shown) or other resilient member may be provided on the arm 49 for urging the hold-down roller 47 downwardly.

In the operation of the device, the strip of sheet metal 12 and the insulating material 10 are placed between the anvil 45 and the hold-down roller 47 with the insulation material overlying the sheet metal. As the shaft 46 is being driven, the anvil 45 continuously moves the sheet metal and the insulating material along the bed 20. At selected intervals the fluid cylinder 32 is energized to drive the head 34 with the fastener 14 thereon downwardly to cause the fastener to penetrate through the insulating material 10 and engage the sheet metal 12. Since the anvil 45 is rotating, little or no pitting occurs on the anvil since the spot below the nail is constantly being changed. Due to the fact that the sheet metal is in intimate engagement with the anvil, a solid base is provided even though the anvil is rotating at the time and accordingly little or no bounce or denting of the sheet metal occurs.

As the fastener 14 begins to penetrate the insulating material on the downward stroke of the piston rod 33, the forward movement of the insulating material and the sheet metal causes the support member 23 to begin to swing outwardly at the bottom so that the fastener remains in substantially fixed position relative to the insulating material and the sheet metal. Outward movement of the bottom of the support member 23 causes such member to move away from the stop 29 and simultaneously compress the spring 28 at the upper end of such member. When the fastener has been driven through the insulating material and is attached to the sheet metal, the forward movement of the material breaks the magnetic contact between the driving head 34 and the fastener 14 at which time the outward force of the spring 28 causes the support member 23 to return to a vertical position against the stop 29. Simultaneously the piston rod 33 is retracted into the fluid cylinder 32 and after the support member engages the stop 29, the fluid cylinder 42 is energized to cause the transfer block to be advanced and transfer another fastener from the chute 35 to the lower end of the magnetic driving head 34 and the operation is repeated.

I claim:

1. Apparatus for mounting insulating material onto sheet metal by means of clinch-type fasteners comprising a frame, at least one fastener applying machine mounted on said frame, said fastener applying machine including a housing, a support member swingably mounted on said housing, fluid cylinder means mounted on said support member and having a downwardly extending piston rod, a magnetic driving head fixed to the lower end of said piston rod, fastener chute means having a portion located adjacent to said driving head, means for transferring a fastener from said chute means to said driving head, a rotatable anvil mounted below said driving head, a hold-down roller located adjacent to said driving head and above said anvil, and means for driving said rotatable anvil, whereby a strip of sheet metal and an overlying strip of insulating material located between said anvil and said roller are driven in a direction normal to said fluid cylinder so that when said cylinder is energized a fastener carried by said magnetic head is caused to penetrate the insulating material and grippingly engage the sheet metal and penetration of said insulating material by said fastener causes said fluid cylinder to swing so that no relative motion between the fastener and the material occurs during the driving process.

2. The structure of claim 1 including resilient means for returning said support member to its initial position.

3. The structure of claim 1 in which a plurality of fastener applying machines are mounted on said frame.

4. In an apparatus for driving fasteners into work and including at least one fastener applying machine, means for supplying fasteners to said fastener applying machine, and said work being continuously moved generally normal to said fastener applying machine, the improvement comprising a rotatable anvil having a portion located directly below said fastener applying machine, means for driving said anvil to cause said work to be advanced, a hold-down roller mounted adjacent to said fastener applying machine and directly over another portion of said anvil, and said fastener applying machine being mounted in a manner such that said fastener applying machine is swung during penetration of the fastener so that no relative movement occurs between the fastener and the work while the fastener is being driven.

5. Apparatus for mounting insulating material onto sheet metal comprising a frame, at least one fastener applying means mounted on said frame, said fastener applying means including a housing, a support member swingably mounted on said housing, a fluid cylinder carried by said support member and having a downwardly extending piston rod, a driving head fixed to the lower end of said piston rod, a plurality of fasteners disposed within fastener chute means having a portion located adjacent to said driving head, means for transferring a fastener from said chute means to said driving head, each of said fasteners being connectable to the sheet metal without penetrating entirely therethrough, an anvil mounted below said driving head, and means for continuously moving said insulating material and said sheet metal through said apparatus between said driving head and said anvil in a direction generally normal to said fluid cylinder, whereby when said fluid cylinder is operated, a fastener carried by said driving head penetrates the insulating material and into engagement with the sheet metal and penetration of the insulating material by the fastener causes said fluid cylinder to swing so that no relative motion occurs between the fastener and the material during the driving process.

6. In an apparatus for driving fasteners through a layer of insulating material and attaching the fasteners to a sheet metal substrate and in which the apparatus includes at least one fastener applying means located along an axis, means for supplying fasteners to the fastener applying means, and an anvil having a portion located generally along the axis of the fastener applying means and being spaced therefrom, the improvement comprising means for swingably mounting said fastener applying means on a frame, means for continuously moving the insulating material and the sheet metal through the apparatus in a direction generally normal to the axis of the fastener applying means, means for intermittently operating the fastener applying means to cause a fastener to penetrate through the insulating material into engagement with the sheet metal substrate, and at least portions of said fastener applying means being moved with the insulating material and the substrate during the penetration and attaching of said fastener, whereby no relative movement occurs between the fastener and the sheet metal while the fastener is penetrating the insulating material and is being attached to the substrate.

7. In an apparatus for driving fasteners into work and including at least one fastener applying machine, and means for supplying fasteners to said fastener applying machine, the improvement comprising a rotatable anvil having a portion located directly below said fastener applying machine, means for causing said work to be continuously advanced generally normal to said fastener applying machine, a hold-down roller mounted adjacent to said fastener applying machine and directly over another portion of said anvil, and said fastener applying machine being mounted in a manner such that said fastener applying machine is swung during the driving of the fastener so that no relative movement occurs between the fastener and the work while the fastener is being driven.

* * * * *